United States Patent [19]

Funk

[11] 4,073,629

[45] Feb. 14, 1978

[54] COAL GASIFICATION PROCESS WITH IMPROVED PROCEDURE FOR CONTINUOUSLY DISCHARGING ASH PARTICLES AND APPARATUS THEREFOR

[75] Inventor: Erwin D. Funk, Glens Falls, N.Y.

[73] Assignee: Kamyr Inc., Glens Falls, N.Y.

[21] Appl. No.: 735,893

[22] Filed: Oct. 26, 1976

Related U.S. Application Data

[63] Continuation of Ser. No. 546,320, Feb. 3, 1975, abandoned, which is a continuation-in-part of Ser. No. 443,116, Feb. 15, 1974, abandoned.

[30] Foreign Application Priority Data

July 30, 1974 South Africa ..... 74/4848

[51] Int. Cl.[2] ..... C10J 3/34

[52] U.S. Cl. ..... 48/77; 48/69; 48/197 R; 48/210; 110/165 R

[58] Field of Search ..... 48/197, 202, 203, 206, 48/210, 63, 73, 76, 77, 69, 86 R, 87, 89, 99, 101, 86 A, DIG. 3, DIG. 4, DIG. 7; 110/28 W, 28 M, 28 Q, 28 Y, 165 R, 171; 162/237, 246; 209/2, 11, 12, 234, 258, 256, 268; 210/297, 400; 214/35 A, 17 CC, 17 R, 17 B; 222/194; 302/11, 14, 15, 16, 66

[56] References Cited

U.S. PATENT DOCUMENTS

| | | | |
|---|---|---|---|
| 1,876,623 | 9/1932 | Daniels | 110/28 W |
| 2,743,217 | 4/1956 | Silsby | 48/206 |
| 2,901,149 | 8/1959 | Richter | 222/367 |
| 2,914,223 | 11/1959 | Richter | 222/194 |
| 3,018,174 | 1/1962 | Steever | 48/63 |
| 3,377,107 | 4/1968 | Hodgson et al. | 302/16 |
| 3,429,773 | 2/1969 | Richter | 162/237 |
| 3,950,146 | 4/1976 | Funk | 48/69 |

FOREIGN PATENT DOCUMENTS

| | | | |
|---|---|---|---|
| 174,094 | 5/1959 | Sweden. | |
| 324,929 | 6/1970 | Sweden. | |
| 290,065 | 5/1928 | United Kingdom | 110/28 W |

*Primary Examiner*—S. Leon Bashore
*Assistant Examiner*—Peter F. Kratz
*Attorney, Agent, or Firm*—Cushman, Darby & Cushman

[57] ABSTRACT

A process of producing gas from gas producing material, such as coal, within a gasifier by continuously heating the material under pressure to produce gas and ash particles, and continuously discharging the ash particles from the gasifier, the continuous discharging comprising the steps of confining a liquid, such as water or the like, within a first path including a volume having a free surface in communication with the gas pressure at the ash particle discharge end of the gasifier, substantially continuously discharging the ash particles into the aforesaid volume of water through the free surface thereof, maintaining a continuous flow of water along a second path at an energy level reduced with respect to the energy level of the water in the first path and continuously removing successive incremental volumes of ash particles entrained in water from communication with the first path and communicating the successive incremental volumes of water and entrained ash particles with the water flowing in the second flow path and apparatus therefor.

38 Claims, 5 Drawing Figures

COAL GASIFICATION PROCESS WITH IMPROVED PROCEDURE FOR CONTINUOUSLY DISCHARGING ASH PARTICLES AND APPARATUS THEREFOR

This application is a continuation of my co-pending application Ser. No. 546,320, filed Feb. 3, 1975, which is a continuation-in-part of my co-pending application Ser. No. 443,116 filed Feb. 15, 1974, both now abandoned.

This invention relates to coal gasification and more particularly to a method and apparatus for removing ash, clinker, char, spent oil shale, or the like from a gasifier under pressure producing synthetic natural gas, water gas, producer gas, etc.

Known methods for discharging of ash particles from vessels under pressure usually involve intermittent operating procedures, the apparatus used consisting of a lock hopper where ash is charged at or near the vessel pressure. The hopper charging port is then isolated from the vessel by a valving device and the hopper is vented to atmospheric pressure. The hopper discharging port is opened and the ash falls by gravity from the hopper. The next ash removal cycle is initiated by closing the hopper discharge port and pressurizing the hopper equally to the vessel pressure. Such known devices usually are provided with compressors and gas storage vessels to accomplish the venting and pressurizing cycles. Other more nearly continuous procedures involve the utilization of charging apparatus such as star wheel conveyors and screw conveyors and are characterized by the charging of materials to the gasifier vessels at or near atmospheric pressure. These types of devices are practically incapable of transferring solid materials while containing large gas pressure differentials across their sealing surfaces.

An object of this invention is to provide a process which serves to improve the discharging of ash particles from known coal gasifiers by making the discharging continuous, to eliminate hopper venting and pressurizing cycles, and to provide a liquid seal volume to prevent gas leakage through the discharging apparatus.

In accordance with the principles of the present invention this objective is obtained by a combination of procedural steps which include confining a liquid, such as water or the like, within a first path including a volume having a free surface in communication with the gas pressure at the ash particle discharge end of the gasifier, substantially continuously discharging the ash particles into the aforesaid volume of water through the free surface thereof, maintaining a continuous flow of water along a second path at an energy level reduced with respect to the energy level of the water in the first path and continuously removing successive incremental volumes of ash particles entrained in water from communication with the first path and communicating the successive incremental volumes of water and entrained ash particles with the water flowing in the second flow path.

Preferably the successive incremental volumes of ash particles and liquid are removed from the first path by maintaining a continuous flow of liquid and entrained ash particles from the volume in communication with the pressure conditions within the gasifier into an incremental volume removal position within the first path. At this position, the flow of ash particles above a predetermined size are blocked while the flow of water and ash particles less than the aforesaid predetermined size are allowed to flow beyond the incremental volume removal position. These blocked particles and the liquid entraining the same constitute the successive incremental volume removed. It is also preferable that for each successive incremental volume of water and entrained particles removed from the first path and communicated with the second path a corresponding incremental volume of water is removed from the second path and communicated with the water in the first path, so that an equal volumetric exchange between the paths takes place, resulting in a net flow of particles from the first path to the second path and an equal net flow of liquid from the second path to the first path. Preferably, this equal volumetric exchange is performed so that it is substantially constant at all times.

In terms of apparatus, the aforementioned volumetric exchange is performed by a known device (see, for example, Swedish Pat. Nos. 174,094 and 324,949) which includes a driven pocketed wheel and a particle blocking screen. In the volumetric exchange leakage is allowed to occur from the high pressure first path to the low pressure second path so that it is not essential to maintain an absolute seal during operation.

The leakage and amount of water and fine particles which are allowed to flow beyond the incremental volume removal position in the first path is coordinated with liquid input into the volume within the first path sufficient to maintain the free surface within a desired level range and the temperature of the liquid at a desired temperature below boiling. Desirably, the amount of flow beyond the incremental volume removal position is sufficient to cause the ash particles which have previously entered the volume of water in communication with the gasifier pressure to be directed by the velocity of flow into the open wheel pocket or pockets. However, the flow beyond the screen which consists of water and fine ash particles, must be handled downstream of the incremental volume removal position. Due to the fine particles in the water and the high energy of the mixture, wear on the confining structure can become a problem, particularly confining structure having moving parts, such as valves and pumps. Where the amount of flow is regulated by a level responsive throttling valve, the wear characteristics are such as to require the utilization of costly antiabrasive materials in the throttling valve structure. Another disadvantage of the use of a level responsive throttling valve is that it reduces the high pressure energy of the flow to atmospheric pressure without efficiently utilizing the energy loss occasioned thereby. Consequently, in order to prevent this energy loss the flow beyond the incremental volume removal position can be recirculated to the volume in communication with the gasifier pressure, in which case, only the pump used to recirculate would be subject to wear. Fines removal without appreciable pressure drop can be utilized to control wear, if necessary.

The present invention also contemplates incremental volume removal without the utilization of controlled particle directing flow through the sluicing device. Since the particle removal function takes place in a high energy medium, the high pressure water leakage alone (or in conjunction with a mechanical assist such as movable baffles or the like) can be utilized to direct the gravity movement of the particles into the open pocket or pockets in which case, the known device is modified simply by replacing the screen with solid metal or equivalently blocking the screen slots.

Accordingly, it is another object of the present invention to provide a combination of known components which will effectively perform the above procedures in accordance with the principles enunciated.

These and other objects of the present invention will become more apparent during the course of the following detailed description and appended claims.

The invention may best be understood with reference to the accompanying drawings wherein illustrative embodiments are shown.

Figure 4:
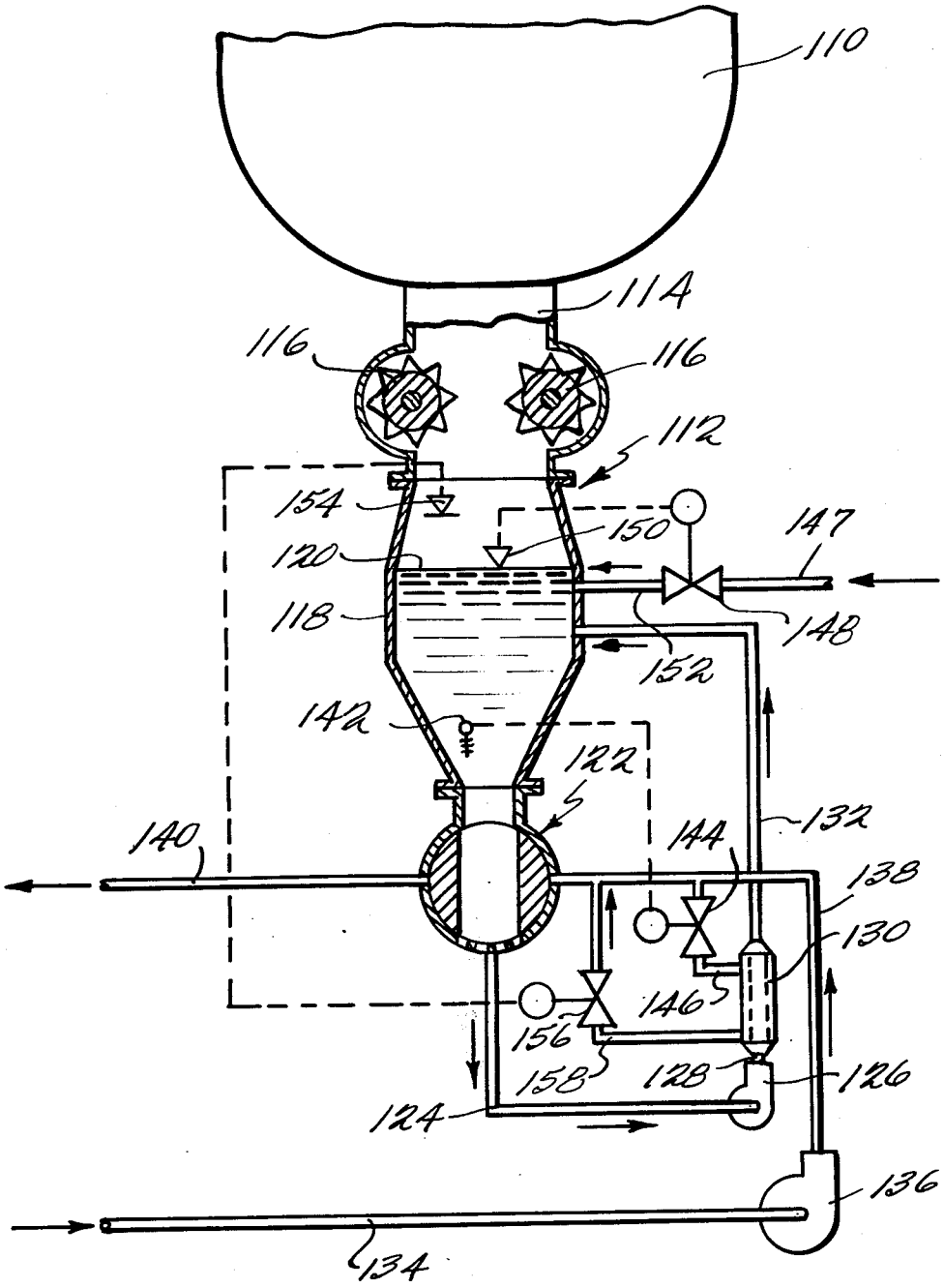
Figure 5:
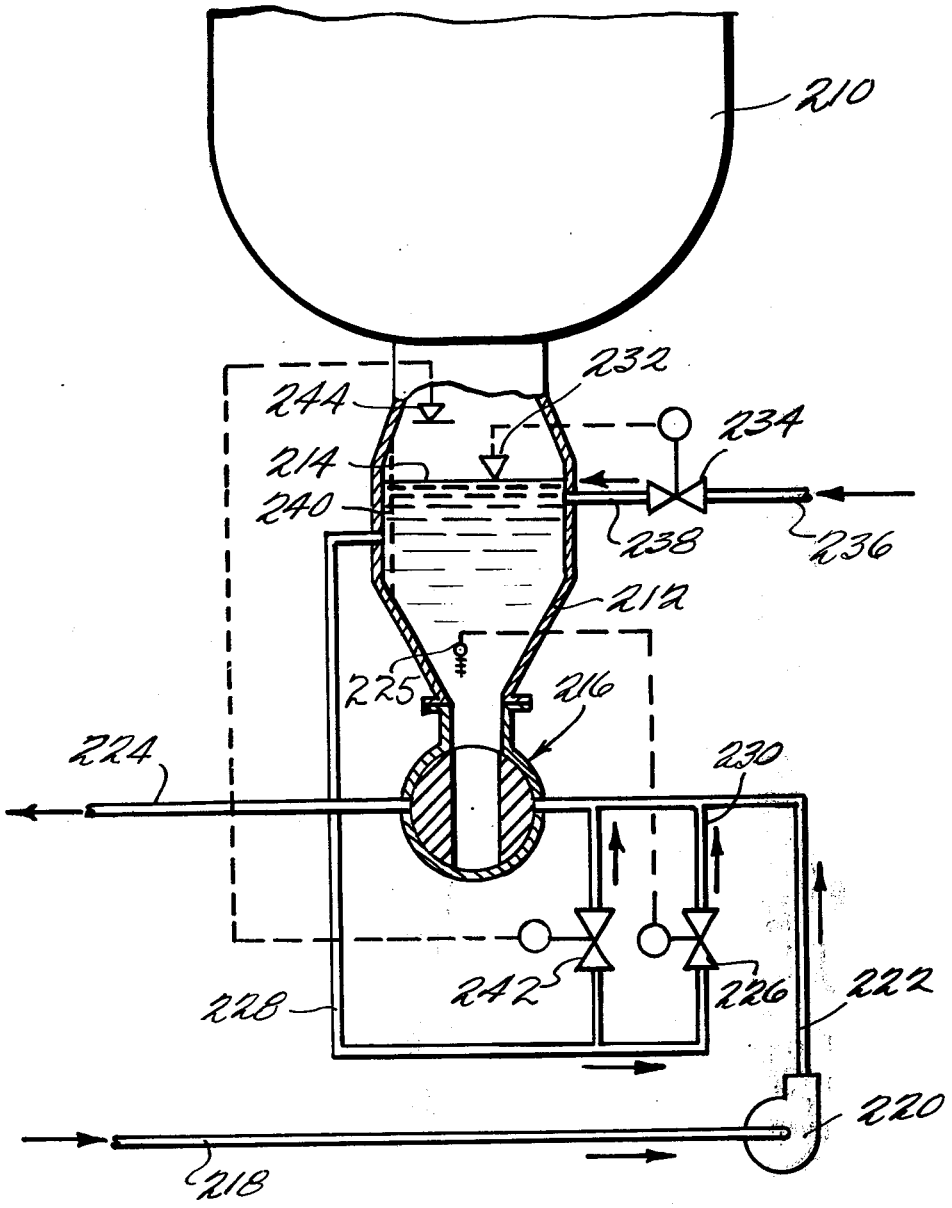

FIG. 4 is a schematic flow diagram illustrating another embodiment of the procedural steps of the present method and an apparatus of the present invention for carrying out the procedural steps of the method; and FIG. 5 is a schematic flow diagram illustrating a further embodiment of the procedural steps of the present method and an apparatus of the present invention for carrying out the procedural steps of the method.

Figure 1:
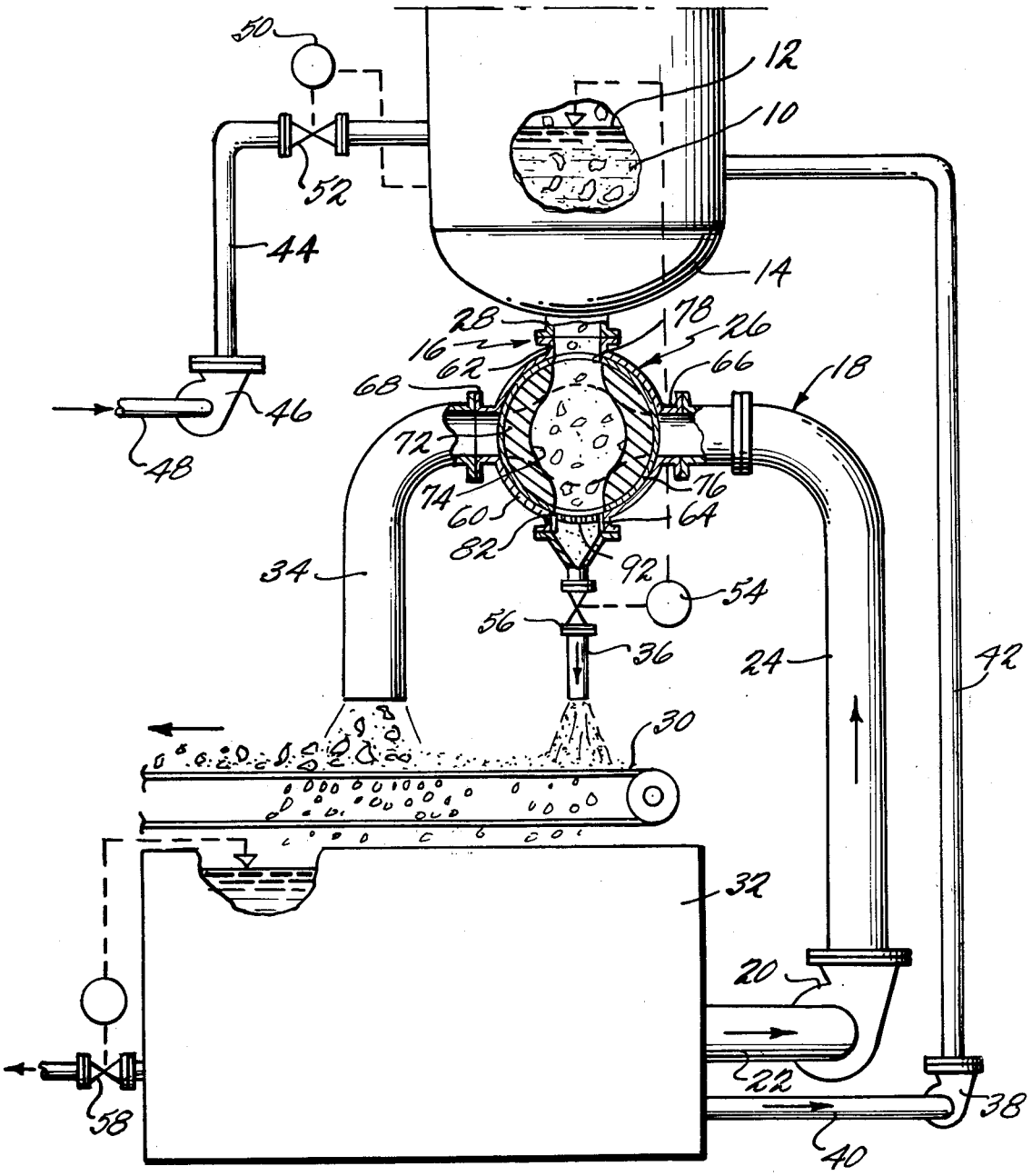
FIG. 1 is a schematic flow diagram illustrating one embodiment of the procedural steps of the present method and an apparatus of the present invention for carrying out the procedural steps of the method.

Referring now more particularly to the drawings, there is shown in FIG. 1 thereof a schematic flow diagram illustrating the procedural steps of the present method. These steps include maintaining a volume of liquid, generally indicated at 10, having a free surface 12 in pressure communicating relation with the discharge end of a coal gasifier vessel, indicated at 14 in the drawings. It will be understood that while the drawings illustrate the volume of liquid 10 to be contained within the bottom end of the gasifier vessel 14, a separate vessel may be provided which is in pressure (e.g. 300 psi and above) communication with the discharge end of the gasifier 14 and which is capable of receiving the ash particles discharged from the discharge end of the gasifier. With the arrangement shown, the ash particles which break up and fall into the discharge end of the gasifier vessel 14 as by rotation of the fixed coal bed grate (not shown) fall into the liquid volume 10 penetrating the upper free surface 12 thereof. While the present invention is particularly suited to fixed bed gasifiers, the invention may advantageously be utilized with any known gasifier where internal pressure conditions must be maintained. Consequently, the gasifier vessel 14 is representative of a known component of a gasifier means for receiving a supply of gas producing material and continuously heating the same under pressure to produce gas and ash particles. It is preferred in accordance with the present invention to utilize water is a liquid. The ash particles are normally quite hot, above the flash point of water. Some flashing of the water occurs as the ash enters the water but this flashing will not be detrimental to the gasification process within the vessel 14 since steam is used as a reactant gas during the gasification. The free liquid or water surface 12 provides a seal to prevent gases under pressure within the gasifier vessel 14 from escaping and such liquid level is maintained nearly constant, as hereinafter more particularly explained.

The present method includes the establishment of a flow of water from the volume 10 along a first flow path, generally indicated at 16, which is maintained by the pressure within the gasifier vessel 14 acting on the free surface 12. The water flowing from the volume 10 along the first flow path 16 includes ash particles entrained therein and at a transfer position downstream from the volume 10, successive volumes of ash particles entrained in water are substantially continuously removed from communication with the first flow path while water with ash particles of a predetermined small size are permitted to flow downstream along the first flow path.

The present method includes the establishment of a flow of water along a second flow path 18 at an energy level less than that of the water in the first flow path 16. As shown, flow along the second path 18 is maintained at a pumping position, as by a pump 20 which draws water from a conduit 22 and discharges the same into a conduit 24. At a transfer position in the second flow path, downstream of the pumping position, the successive volumes of ash particles entrained in water removed from the first flow path 16 are substantially continuously communicated with the water in the second flow path.

The procedure of continuously transferring communication of successive volumes of water entrained ash particles from the first high energy flow path to the second low energy flow path is accomplished by a transfer or sluicing device, generally indicated at 26, which is communicated with the first flow path, as by a conduit 28, and with the second flow path by the conduit 24.

The method of the present invention includes the step of substantially continuously separating the ash particles from the water in the second flow path at a separation position downstream of the transfer position. While any suitable known device may be used to effect this separation, a preferred device shown in the drawings is in the form of an endless foraminous conveyor belt arranged to be continuously moved in a position above a water collecting tank or receptacle 32. With this arrangement water and ash particles flowing in the second flow path from the transfer device 26 is simply directed onto the uper flight of the foraminous belt 30, as by a conduit 34. It will be understood that the size of the openings in the foraminous belt 30 are such that the ash particles are retained on the upper surface of the upper flight and carried thereby to a spaced discharge position. Water discharging from the conduit 34 onto the foraminous belt passes through the openings therein and is collected in the receptacle 32.

An advantage of utilizing a separator of the foraminous belt type is that it may also be utilized along with the receptacle 32 to effect a separation between the small ash particles and water flowing in the first flow path 16 downstream of the transfer position thereof. As shown, this dual performance can be achieved by means of a conduit 36 extending from the transfer device 26 which discharges above the upper flight of the belt 30. The ash particle-water separation is performed, as before, with the ash particles being carried to the discharge position and discharged with the larger particles separated from the liquid of the second flow path. It will be understood that the foraminous belt 30 can be maintained in an unclogged condition by the usual practice of back washing the return flight.

The utilization of a common receptacle 32 for the separated water in both flow paths is desirable from the standpoint of heat exchange and minimizing the pumping and controls. With the arrangement shown, the water held in receptacle 32 forms the same for the second flow path by simply connecting supply conduit 22 with the interior of the receptacle. The water in receptacle 32 is also used to maintain the level of surface 12 of water volume 10 in the bottom of vessel 14. This is accomplished by pumping water therefrom, as by a pump 38 communicated therewith by a supply conduit 40, to the volume 10, as by a conduit 42.

Since the ash particles enter the water of the first high energy flow path at temperatures above the boiling point of water and successive volumes of ash particles and water from the first high energy flow path are continuously transferred to the second low energy flow path, the water temperature in both flow paths will eventually reach the boiling point unless steps are taken to control this temperature increase. Such control is provided in accordance with the present invention by utilizing fresh cool water as part of the water source for maintaining the volume 10, along with the water from tank 32 pumped therein through conduit 42 by pump 38. As shown, fresh cool water is supplied to the volume 10 through a conduit 44 connected between the vessel 14 and the pressure side of a pump 46, the suction side is communicated with a fresh cool water supply, as by conduit 48. The amount of cool water utilized is just sufficient to maintain the water temperature in the system from increasing beyond a predetermined temperature. This temperature is preferably sensed in the volume 10 by conventional temperature sensing means 50 which is utilized to regulate a flow control valve 52 in conduit 44, also in accordance with conventional practice. The level of the surface 12 of water volume 10 is maintained by conventional level sensing means 54 which is utilized to regulate a throttling valve 56 in conduit 36.

The level of water volume 10 tends to increase because of water being supplied by pumps 38 and 46. The level tends to decrease because of leakage within the transfer device 26. The net tendency for change in level is to increase the level since the rate of flow from pumps 38 and 46 is greater than the leakage. The level is maintained constant by the throttling valve 56 set to control the level. This level control also provides for continuous flow through the transfer device 26 in the first flow path. The introduction of new water from the temperature control system results in a net gain of water in tank 32. This net gain is drained through level control valve 58. The draining of water from tank 32 and the addition of new water tends to reduce the concentration of very small fines thus allowing pumps 20 and 38 to operate on minimal abrasive materials.

Figure 2:
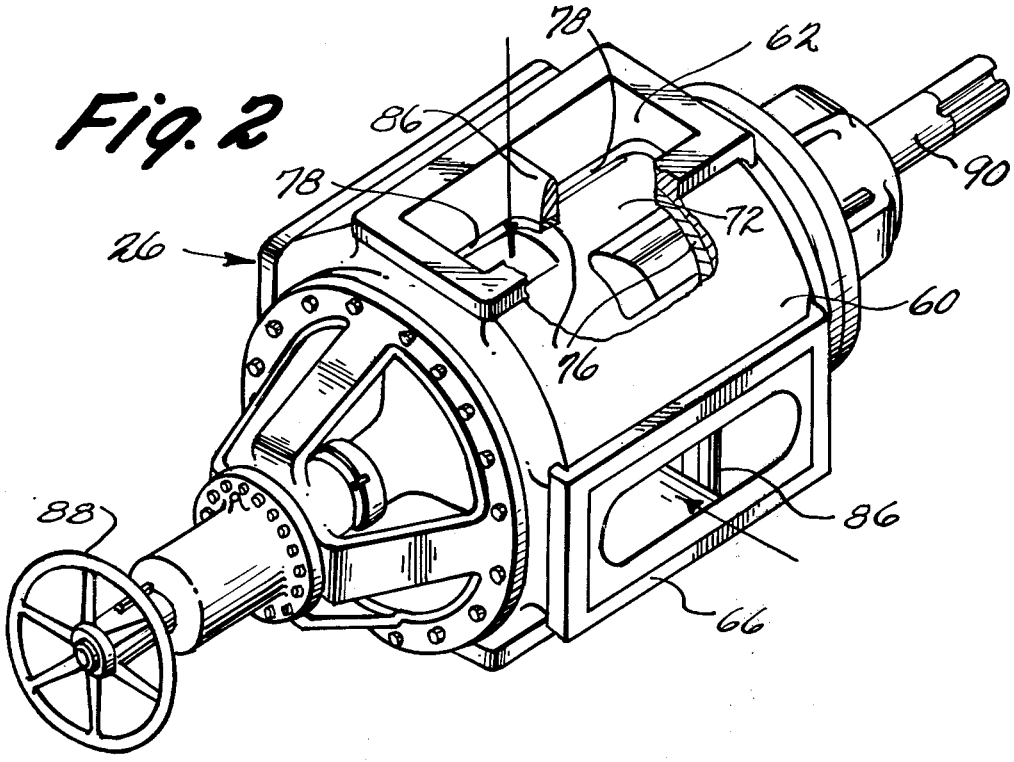
FIG. 2 is a perspective view of the transfer device.
Figure 3:
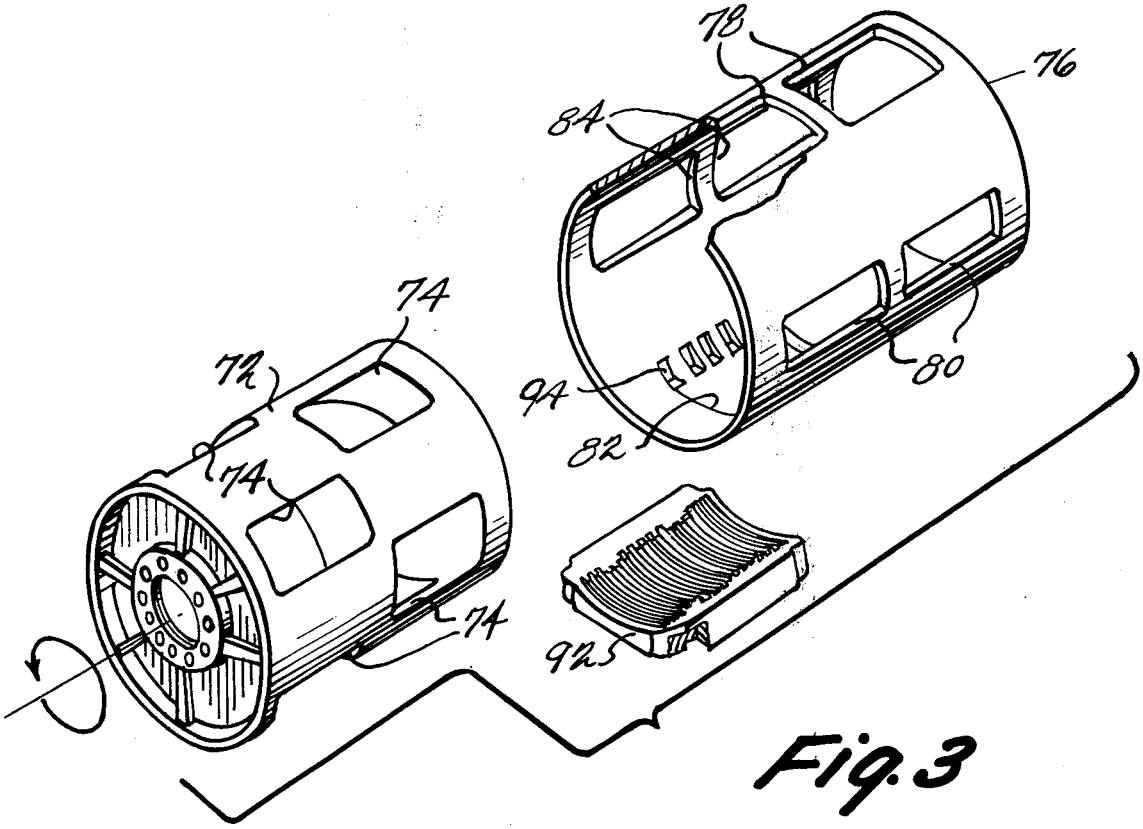
FIG. 3 is an exploded perspective view illustrating certain parts of the transfer device shown in FIG. 2.

It can be seen that the transfer device 26 is a significant component in the combination forming the apparatus of the present invention. The preferred device 26 is known per se for use with pulp digesters and is disclosed in the aforesaid Swedish Pat. Nos. 174,094 and 324,949. As best shown in FIGS. 2 and 3, the device 26 includes a housing 60 having an open upper end 62 communicating with conduit 28 of the first flow path and a lower open end 64 which communicates with conduit 36. The housing 60 of the transfer device 26 also includes an inlet 66 which receives low energy level water flowing in the second flow path 18 coming from the pump 20 through conduit 24, and an outlet 68 which discharges into conduit 34. Transfer device 26 is shown in solid lines in FIG. 1 in communicating relation with the first flow path 16, the communication with the second flow path 18 being shown in dotted lines.

As best shown in FIGS. 2 and 3, the transfer device 26 includes a pocketed wheel 72 containing two rows of diametrically through going pockets 74, each row containing two through going pockets perpendicular to each other presenting four open ports equally spaced around the periphery of the wheel for each row. The two rows of pockets are parallel, one row being 45 degrees displaced peripherally from its adjacent row as is shown in FIG. 3. The pocketed wheel 72 is encased by housing 60 and mounted for rotation within a housing liner 76. As best shown in FIG. 2, the liner 76 includes four ports 78, 80, 82 and 84, equally spaced around the periphery of the housing which register respectively with inlet 62, inlet 66, outlet 64 and outlet 68. Each port is more than twice as wide as the sum of two pockets 74 in the pocketed wheel and a divider 86 is located midway in each housing port to separate the same into two parallel ports, as clearly depicted in FIGS. 2 and 3.

The pocketed wheel 72 may be either cylindrical or tapered; illustration of such being shown in FIGS. 2 and 3 as tapered with wheel diameter increasing in the direction of a clearance adjusting hand wheel 88. Tapering of the wheel 72 provides for adjustment of the clearance between the wheel 72 and housing liner 76; additionally, increase in clearance due to wear can be taken up by turning hand wheel 88 pushing wheel 72 toward a shaft drive end 90 shown in FIG. 2. The pockets 74 through wheel 72, in a row, loop over each other so as to provide passage through the wheel while maintaining inline openings in the wheel around the periphery of the wheel. While looping, the pocket becomes narrower but wider, such widening being shown in FIG. 1; the narrowing being necessary to accomplish the looping over of passages and the widening being provided to maintain a nearly constant pocket cross-sectional area for water and ash particle flow.

Ash particles entering the transfer device 26 with water through inlet 62, under the gas pressure of the gasifier, are moved through ports 78 and 82. A screen 92 is disposed within each port 82 so that fine ash particles and liquid pass through each screen 92 but particles of the predetermined size range larger than the screen opening are thus held in the communicating wheel pocket 74. As the filled pocket 74 rotates and begins to approach a position nearly perpendicular to its filling position, low energy liquid in the second flow path 18 from pump 20 is forced through conduit 24 and port 80 into the pocket causing discharging of ash particles from the pocket through port 84 into conduit 34. Before the pocket again rotates to the filling position all ash particles are emptied into conduit 34 leaving only liquid in the pocket. The pocketed wheel 72 rotation is continuous but the filling and emptying of pockets in a single row of pockets is intermittent. Since the adjacent parallel row of pockets displaced 45 degrees peripherally, is also intermittently filling and discharging, the sum of these two intermittent filling and discharging rows of pockets is continuous. The continuous operation is an effect of the peripheral displacement of the two parallel rows of pockets, such displacement being shown in FIG. 3, for as a pocket is closing to a housing inlet port a pocket is opening to the same port, thus always maintaining a constant open cross section through the first flow path filling ports 78 and 82 and the second flow path discharging ports 80 and 84 making the filling and discharging circulation systems continuous.

The transfer device 26 is uniquely characterized by several important internal features. The first of these is the ability to transfer ash particles from one flow path to another flow path at lower pressure without the need for positive sealing surfaces. According to the present invention the rotating pocketed wheel 72 need not come into intimate contact with the housing liner 76 but may present a clearance therewith. Since ports 78 and 82 are at a higher pressure than ports 80 and 84 a leakage occurs in the form of liquid flow from ports 78 and 82 to ports 80 and 84 through the clearance. The liquid flow through the clearance is maintained small by maintaining the clearance narrow. The small liquid flow provides a lubrication and cleaning function which prevents binding of rotating wheel 72 with housing liner 76. Secondly, another unique feature of the transfer device 26, is the screening out of fine material through screens 92. During filling of a pocket 74 in the rotating wheel 72, fine ash particles are drawn through the peripheral slots in screens 92. The slots are sized to remove particles below a predetermined small size (e.g., approximately 3 mm). The constructional form of the transfer device 26 is such that self-cleaning of the screens 92 is provided, such cleaning being performed by the edge of the rotary wheel pocket as the edge passes over the slots. Thirdly, the liner 76 may be provided with one or more grooves 94 adjacent the port openings 78 and 82, as shown in FIG. 3. The grooves 94 are formed with a peripheral dimension which is greater than the dimension measured in the radial direction, so that a liquid flow at high pressure into the pocket openings 78 and 82 is exposed to strong choking action. Consequently, shocks and vibrations originating on pocket to port opening are milder reducing the tendency of ash particles to break. Lastly, the water used as a conveying medium tends to prevent cutting of ash particles when the rotating wheel pocket edge closes housing filling port 80 to the wheel pocket with the wheel 72 rotating at a low RPM, preferably 1 to 10 RPM. The water provides some buoyancy to the ash particles and the pocket edge will tend to push the particle away rather than pinch or cut off the particle between the pocket edge and the housing filling port edge. As the pocket being filled closes off to the filling port, the pocket in the parallel row of pockets is approaching full open to the filling port so that the majority of liquid flow is through this pocket, carrying all of the particles into this pocket, leaving none or nearly none to be pinched off by the closing pocket.

The flow of high pressure water which is maintained through the screens 92 tends to direct the ash particles to move into the pocket or pockets which are open and hence to prevent deposit of ash particles on the periphery of the wheel which is blocking the inlet of the ash particles into the pockets. This action tends to reduce wear on the wheel periphery. However, the directing flow through the wheel pockets results in the necessity to handle a flow of high pressure water and entrained fine ash particles downstream of the screens 92. In the arrangement described above for handling this flow, abrasive resistant materials must be utilized in the construction of the throttling valve 56 in order to prevent too frequent shut down for replacement of worn valve parts. The wear characteristics of a valve operable to throttle a high pressure flow of water and fine ash particles to atmospheric pressure are exceedingly demanding. Moreover, while this throttling action enables the system to utilize a simple single separator 30 operating at atmospheric pressure for both the large and fine ash particles, it also involves substantial energy losses.

In FIG. 4 there is shown a schematic diagram of a system embodying the principles of the present invention illustrating modifications in which the energy losses attendant to throttling of the high pressure flow to the atmosphere are minimized. The system of FIG. 4 also illustrates procedures for insuring against blockage of the sluicing device by the presence of oversize ash particles lodging in the inlet.

Referring now more particularly to FIG. 4, the system shown therein includes a gasifier vessel 110, the discharge end of which is communicated with an annular housing assembly 112. The housing assembly includes an upper section 114 which is interiorly communicated with the interior gas pressure of the gasifier vessel 110 and is configured to receive therein suitable ash particle breaking means 116. While the breaking means 116 may be of any conventional type, such as, single roll, swing hammer or jaw type, a preferred double roll type is schematically illustrated in FIG. 4. It is important to note that the double roll breaking means 116 is contained within the housing section 114 so that the rolls operate under the gasification vessel pressure conditions which normally exceed 300 psig.

It will be noted that as the ash particles drop by gravity from the gasifier vessel 110, they will pass between the dual breaker roll of the breaking means 116. The spacing of the rolls is coordinated with the size of the sluicisng device utilized exemplary setting being between 4 to 6 inches. Ash particles of a size less than the roll spacing (e.g., 4 inches) will pass from the gasifier vessel 110 through the upper housing section 114 into a lower housing section 118. The lower housng section 118 which is in the form of an annular wall serves as a part of the means for confining liquid such as water within a first path. The liquid in the first path includes a volume within the housing section 118 having a free surface 120 which communicates with the gas pressure conditions within the gasifier vessel 110.

The smaller ash particles thus pass directly into the volume of water within the housing section 118 downwardly through the free surface 120. Ash particles larger than the spacing between the breaker rolls will be engaged thereby and broken up before passing downwardly through the free water surface 120. Although the breaker rolls 116 are shown above the free surface 120 for dry operation, they could be located below the free surface for wet breaking, if desired.

The lower end of the housing section 118 opens to the upper inlet of a sluicing device 122 which is constructed like the sluicing device 26 previously described.

In the embodiment shown in FIG. 4, the means for confining the high pressure water within the first path includes a suitable conduit 124 leading from the lower outlet of the sluicing device 122 to the suction side of a centrifugal pump 126, a conduit 128 leading from the pressure side of the pump to an inline drainer 130 and a conduit 132 leading from the inline drainer back into the interior of the housing section 118.

With this construction the first path is circulatory from the housing section 118, through the sluicing device 122 and back to the housing section 118 so that the high energy of the liquid is not dissipated to atmosphere as is the case with the use of the throttling valve 56. Pump 126 requires very little energy to operate since it primarily performs a circulating function, its pressurization function being limited to that required to overcome line losses. Pump 126 is subjected to wear since it is operating on water having fine ash particle entrained therein. However, it will be noted that the wear is considerably less than that imposed upon throttling valve 56 since high velocity flows of the intensity of those created in the latter are not imposed on the moving parts of pump 126. The pressure (e.g., 5 to 10 feet of $H_2O$) and wear requirements of pump 126 are well within existing slurry pump capabilities.

Inline drainer 130 is provided as a simple but effective device and procedure for providing a source of ash particle free water within the first path which can be drained off to maintain the free surface 120 within a desired constant level range and the water defining the same within a desired temperature below boiling. The inline drainer constitutes a generally cylindrical housing having a cylindrical screen mounted concentrically therein inline with the flow. The velocity of flow through the drainer is such that the major quantity of liquid and almost all of the small ash particles in the flow are directed longitudinally through the drainer within the screen such that the screen does not tend to clog. A minor quantity of liquid can be drained from the interior periphery of the housing without inducing appreciable movement of the fine ash particles into or through the openings of the screen.

In the system shown in FIG. 4, the means for maintaining a flow of water at a reduced energy level along a second flow path is illustrated schematically as a supply conduit 134 leading from a water supply to the suction side of a centrifugal pump 136, a conduit 138 leading from the pessure side of the pump 136 to the side inlet of the sluicing device 122 and a conduit 140 leading from the side outlet of the sluicing device 122.

In the system shown in FIG. 4, conduit 140 leading from the sluicisng device 122 directs the ash particles and water to an independent ash and water separation facility which is not schematically illustrated in the drawings. The independent facility may be a settling pond, thickener or any mechanical facility which recovers ash for product use. The water supply for supply conduit 134 is likewise not shown but may be a fresh water source or the purified water from the independent ash particle separation facility.

With the system of FIG. 4, level and temperature control of the water within the housing section 118 is maintained by draining liquid from the circulatory first path through the drainer 130 into the second path when the temperature of the water volume reaches a predetermined value below boiling sufficient to prevent flashing within the sluicing device due to pressure drop. As shown this drainage is accomplished by sensing the temperature of the water, as by a temperature sensing mechanism 142 within the water which operates a drain valve 144 within a conduit 146 leading from the drainer 130 to the inlet conduit 138 of the second path. The water temperature is lowered by the introduction of a supply of cool water into the housng section 118 through a conduit 147 leading from the supply (not shown) to a control valve 148 operated by a level sensing mechanism 150 and a conduit 152 leading from the valve 148 to the interior of the housing section 118.

Under most operating pressures, the leakage within the sluicing device 122 from the high pressure first path to the low pressure second path would be greater than the net flow of water from the second flow path to the first flow path due to ash particle displacement. Consequently, it would be expected that temperature controlled valve 144 would remain closed most of the time while cool water supply valve would be open most of the time to maintain the water level and hence the desired temperature level. Where lower operating pressures are expected and as an added safety feature under any conditions to prevent the flooding of water upwardly into the gasifier vessel discharge end, a high level sensing machanism 154 is mounted within the housing section 118 for controlling a safety valve 156 mounted within a conduit 158 leading from the drainer 130 to the second path inlet conduit 138.

The system of FIG. 4 has the advantage of avoiding the energy loss occasioned by throttling to atmospheric pressure as with the system of FIG. 1. This advantage is achieved by recirculation and therefore the system has a greater tendency for fines to become concentrated in the water within the first path. It should be noted however that since the fines passing through the sluicing device screen are reentered into the water above the sluicing device many of these fines will again pass through a pocket of the sluicing device 122 which is partially filled and will therefore be retained with these particles by a straining action for passage into the second path after filling. Sufficient fines are sluiced away in this fashion to prevent fines build up to the point of requiring shut down and removal. Should fines concentration become significant, a cyclone could be used in lieu of the inline drainer 130 to separate out the fines. The pressure drop loss can be minimized by restricting the underflow outlet or by providing dual outlet valves. The disadvantages of the cyclone energy loss may be offset by savings in pump wear by placing the cyclone upstream of the pump so that its overflow outlet communicates with the suction side of the pump. Similarly a cyclone could be utilized to reduce wear on the throttling valve 56.

FIG. 5 illustrates an embodiment of the present invention in which the means for confining the water within the first path is simplified by eliminating flow through the lower sluicing device outlet. This apparatus and process simplification is somewhat offset by the lack of positive flow direction of the ash particles into the sluicing device pockets. In FIG. 5, a gasifier vessel 210 is shown with its discharge end in communication with housing 212 which confines the water within the first path, including the volume having free surface 214 downwardly through which the ash particles from the vessel pass. It will be understood that suitable ash particle breaking means similar to that shown in FIG. 4 may be provided if desired as is also the case with the system of FIG. 1. Likewise the system of FIG. 4 may be utilized without the ash particle breaking means 116 shown therein.

Housing 212 leads to the upper inlet of a sluicing device 216 which is constructed like the device 26 previously described except that screens 92 are replaced by solid plates. The second reduced energy flow path is provided by supply conduit 218, pump 220, inlet conduit 222 and outlet conduit 224 in a manner similar to that provided in the system of FIG. 4. Level and temperature control of the water in housing 212 is maintained by temperature sensing means 225 controlling valve 226 connected between conduits 228 and 230 and level sensing means 232 controlling valve 234 between cool water supply conduit 236 and conduit 238 leading into the housing 212. Conduit 228 leads from the interior of the housing 212 to the temperature control valve 226 while conduit 230 leads from the valve to the inlet conduit 222 of the second path. In order to protect the valve from fine ash particles as much as possible, a screen 240 is provided within the housing in surrounding relation to the inlet to conduit 228. An anticlogging device, such as a moving wiper (not shown), may be utilized with screen 240, if desired. A safety valve 242, similar to valve 156, operated by a high level sensing mechanism 244 may be mounted in parallel with temperature sensitive valve 226.

In this embodiment, leakage through the sluicing device 216 will more than offset the ash particle displacement from the second flow path, such leakage providing some flow directing tendecy of the ash particles within the water volume toward the sluicing device pockets. Gravity flow of the particles within the water is also relied upon to fill the pockets. This embodiment is particularly suited to very slow wheel speeds of the order of 1 RPM and below. A sluicing device of greater capacity than that needed in the other embodiments may be desirably used.

It thus will be seen that the objects of this invention have been fully and effectively accomplished. It will be realized, however, that the foregoing preferred specific embodiment has been shown and described for the purpose of illustrating the functional and structural principles of this invention and is subject to change without departure from such principles. Therefore, this invention includes all modifications encompassed within the spirit and scope of the following claims.

What is claimed is:

1. A process of producing gas from gas producing material, such as coal, within gasifier means by continuously heating the material under pressure to produce gas and ash particles, and continuously discharging the ash particles from the gasifier means, the improvement wherein said continuous discharging comprises the steps of:

confining water within a first path including a volume having a free surface in communication with the gas pressure at the ash particle discharge end of the gasifier means, substantially continuously discharging the ash particles into said volume of water through the free surface thereof, maintaining a continuous flow of water along a second path at an energy level less than the energy level of the water in said first path and continuously removing successive incremental volumes of ash particles entrained in water from communication with said first path and communicating said successive incremental volumes of water and entrained ash particles with the water flowing in said second path, said successive incremental volumes being removed from said first path by confining ash particles entrained in water to move into an incremental volume removal position within said first path, blocking the movement of the ash particles at said incremental volume removal position and successively removing an amount of blocked particles and the liquid entraining the same at the time of removal equal to said incremental volume.

2. A process as defined in claim 1 wherein said ash particles entrained in water are confined to move into said incremental volume removal position by maintaining a continuous flow of water and entrained ash particles from said volume into said incremental volume removal position within said first path where the flow of ash particles above a predetermined size are blocked while water and ash particles less than said predetermined size are permitted to flow beyond said incremental volume removal position.

3. A process as defined in claim 2 wherein said continuous flow of water and entrained ash particles from said volume in said first path is maintained by pumping a portion of the water flowing beyond said incremental volume removal position back into said volume without reducing the energy level thereof to atmospheric conditions.

4. A process as defined in claim 3 wherein the volume of water within said first path is continuously maintained below a boiling temperature and the free surface thereof is continuously maintained within a predetermined level range by continuously sensing the temperature of the volume of water in said first path, directing high temperature water from said first path into said second path when the temperature sensed is above a predetermined value, sensing the level of said free surface, directing water from said volume into said second path when the level sensed is above a predetermined value and directing a supply of low temperature water into said volume when the level sensed is below a predetermined value.

5. A process as defined in claim 2 including the step of separating the ash particles from the water flowing along said second path.

6. A process as defined in claim 5 including the step of substantially continuously separating the small ash particles and the water in said first path at a separation position downstream from said incremental volume removal position.

7. A process as defined in claim 6 wherein the separation of ash particles and water in both paths is accomplished by directing the water and entrained ash particles in both paths onto a continuously moving endless foraminous conveyor belt so that the ash particles are retained on the moving conveyor belt and subsequently discharged therefrom at a spaced discharge position while the water passes therethrough.

8. A process as defined in claim 7 wherein the water in both paths separated from the ash particles by passage through said foraminous conveyor belt is collected in a common receptacle.

9. A process as defined in claim 8 wherein said first path is maintained by pumping water from said receptacle to the aforesaid volume in communication with the gas pressure within said gasifier means.

10. A process as defined in claim 9 wherein the aforesaid volume in communication with the gas pressure within said gasifier means is maintained at a predetermined temperature below boiling and at a predetermined level by sensing the temperature thereof and introducing cool water therein in response to the water temperature sensed and by sensing the water level of said volume and throttling the flow along said first path at a throttling position between said transfer and separation positions in response to the level sensed.

11. A process as defined in claim 1 wherein for each successive incremental volume of water and entrained particles removed from said first path and communicated with said second path a corresponding incremental volume of water is removed from said second path and communicated with the water in said first path so that an equal volumetric exchange between said paths takes place resulting in a net flow of particles from said first path to said second path and an equal net flow of liquid from said second path to said first path.

12. A process as defined in claim 11 wherein said equal volumetric exchange between paths is performed continuously in such a way that the quantity of liquid exchanged between said paths is constant.

13. A process as defined in claim 2 including the step of reducing the ash particles to a size below a predetermined value between the position of discharge thereof and said incremental volume removal position.

14. A process as defined in claim 13 wherein said ash particle size reduction is performed prior to the discharge thereof through the free surface of said water volume in said first path.

15. A process as defined in claim 13 wherein said ash particle size reduction is accomplished by passing the ash particles between a cooperating pair of breaker rolls.

16. A process as defined in claim 1 wherein the volume of water within said first path is continuously maintained below a boiling temperature and the free surface thereof is continuously maintained within a predetermined level range by continuously sensing the temperature of the volume of water in said first path, directing high temperature water from said first path into said second path when the temperature sensed is above a predetermined value, sensing the level of said free surface, directing water from said volume into said second path when the level sensed is above a predetermined value and directing a supply of low temperature water into said volume when the level sensed is below a predetermined value.

17. Apparatus for producing gas from gas producing material, such as coal, comprising gasifier means for receiving a supply of gas producing material and continuously heating the same under pressure to produce gas and ash particles and means for continuously removing ash particles from said gasifier means under pressure, the improvement which comprises said ash removal means comprising:

means for confining water within a first path including a volume having a free surface in communication with the pressure within said gasifier means for receiving therein ash particles produced within said gasifier means by passage through said free surface, means for maintaining a continuous flow of water along a second path at an energy level less than the energy level of the water in said first path, and means for continuously removing from communication with said first path successive incremental volumes of ash particles entrained in water and continuously communicating said successive incremental volumes of ash particles and entrained water with the water flowing in said second path, said means for continuously removing and communicating successive incremental volumes comprising a sluicing device comprising housing means having first path inlet means and second path inlet means and outlet means formed therein, a wheel rotatably mounted in said housing means having a plurality of separate pockets extending therethrough for alternately communicating with said first path inlet means and between said second path inlet means and outlet means during rotation thereof within said housing means.

18. Apparatus as defined in claim 17 wherein said housing means also has outlet means said plurality of separate pockets alternately communicating between said first path inlet means and outlet means and said second path inlet means and outlet means during rotation thereof within said housing means, and screen means in said first path outlet means.

19. Apparatus as defined in claim 18 wherein said first path inlet means includes a pair of first inlet ports spaced axially with respect to the rotational axis of said wheel, said first path outlet means including a pair of axially spaced first outlet ports axially aligned with and displaced 180° from said first inlet ports with respect to the rotational axis of said wheel, said second path inlet means including a pair of axially spaced second inlet ports axially aligned with and displaced 90° from said first inlet ports, said second path outlet means including a pair of axially spaced second outlet ports axially aligned with and displaced 180° from said second inlet ports, said wheel pockets including two axially spaced rows of pockets each containing two separate pockets of generally uniform cross-sectional area, each pocket of each row having axially aligned ends displaced 180° from each other with the ends of one pocket being displaced 90° with respect to the ends of the other pocket of the row and 45° with respect to the ends of a comparable pocket in the other row, the shape of the ends of said pockets being related to the shape of said ports such that each end during the rotation of said wheel moves progressively from a position of generally zero communication to full communication and then back to generally zero communication with each successive port axially aligned therewith.

20. Apparatus as defined in claim 19 wherein said wheel is tapered, said housing means being correspondingly tapered, and wherein said means for continuously removing and communicating successive incremental volumes further includes an adjusting handwheel for setting the clearance between the tapered wheel and said tapered housing means.

21. Apparatus as defined in claim 20 wherein said housing means includes a liner engaging said rotation pocketed wheel for the purpose of wear.

22. Apparatus as defined in claim 21 wherein said liner is formed with grooves adjacent the edges thereof defining said first inlet and outlet ports, said grooves having a peripheral dimension which is greater than the dimension measured in the radial direction, said grooves decreasing in depth with increasing distance from the edge of the pocket.

23. Apparatus as defined in claim 18 wherein said first path confining means includes annular wall means for confining said volume and means communicating the lower end of said annular wall means with said first path inlet means, first conduit means communicating said first path outlet means with the interior of said wall means and first pump means within said first conduit means.

24. Apparatus as defined in claim 23 wherein said means for maintaining a continuous flow of water along said second path comprises second conduit means leading into said second path inlet means having second pump means therein and third conduit means leading from said second path outlet means.

25. Apparatus as defined in claim 24 including inline drainer means in said first conduit means downstream of said first pump means, fourth conduit means leading from said inline drainer means to said second conduit means at a position downstream of said second pump means, first water level responsive means in said fourth conduit means, and first level sensing means within said annular wall means for sensing the level of the free surface of the volume of water contained therein and operating said first level responsive valve means, cold water supply conduit means leading to the interior of said annular wall means, second water level responsive valve means within said cold water supply conduit means, second level sensing means within said annular wall means for sensing the level of the free surface of the volume of water contained therein and operating said second level responsive valve means, fifth conduit means in parallel with said fourth conduit means and temperature responsive valve means within said fifth conduit means, and temperature sensing means within said annular wall means for sensing the temperature of the volume of water contained therein and for operating said temperature responsive valve means.

26. Apparatus as defined in claim 18 wherein said first path confining means includes conduit means leading from said first path outlet means, throttle valve means in said conduit means, level sensing means for sensing the level of the free surface of said volume of water and operating said throttle valve means to control the level of said free surface, water temperature sensing means for sensing the temperature of said volume of water, and means operable in response to said water temperature sensing means for introducing a supply of cool water into said volume to maintain the temperature thereof at a predetermined temperature below boiling.

27. Apparatus as defined in claim 26 including means for separating the fine ash particles and water flowing in said firtst path downstream of said throttle valve means.

28. Apparatus as defined in claim 27 wherein said separating means comprises a continuously moving endless foraminous conveyor belt receiving the fine ash particles and water flowing downstream of said throttle valve means so that the ash particles are retained thereon and subsequently discharged therefrom at a spaced discharge position while the water passes therethrough, and a receptacle for receiving the water passing through said moving conveyor belt.

29. Apparatus as defined in claim 28 wherein said means for maintaining a continuous flow of water along said second path includes means for directing the water and ash particles in said second flow path flowing downstream of said second path outlet means onto said foraminous conveyor belt so that the ash particles are retained thereon and subsequently discharged at said discharge position while the water passes through the moving conveyor belt into said receptacle.

30. Apparatus as defined in claim 29 wherein said means for maintaining a continuous flow of water along said second path includes conduit means leading from said receptacle to said second path inlet means having pump means therein.

31. Apparatus as defined in claim 30 wherein said first path confining means includes pump means for pumping water from said receptacle into said volume of water.

32. Apparatus as defined in claim 17 wherein control means is provided for maintaining the volume of water in said first path at a temperature below boiling and the free surface thereof within a predetermined range of levels.

33. Apparatus as defined in claim 17 wherein said first path inlet means includes a pair of first inlet ports spaced axially with respect to the rotational axis of said wheel, said second path inlet means including a pair of axially spaced second inlet ports axially aligned with and displaced 90° from said first inlet ports, said second path outlet means including a pair of axially spaced second outlet ports axially aligned with and displaced 180° from said second inlet ports, said wheel pockets including two axially spaced rows of pockets each containing two separate pockets of generally uniform cross-sectional area, each pocket of each row having axially aligned ends displaced 180° from each other with the ends of one pocket being displaced 90° with respect to the ends of the other pocket of the row and 45° with respect to the ends of a comparable pocket in the other row, the shape of the ends of said pockets being related to the shape of said ports such that each end during the rotation of said wheel moves progressively from a position of generally zero communication to full communication and then back to generally zero communication with each successive port axially aligned therewith.

34. Apparatus as defined in claim 33 wherein said wheel is tapered, said housing means being correspondingly tapered, and an adjusting handwheel for setting the clearance between the tapered wheel and said tapered housing means.

35. Apparatus as defined in claim 34 wherein said housing means includes a liner engaging said rotating pocketed wheel for the purpose of wear.

36. Apparatus as defined in claim 17 wherein said first path confining means includes a housing assembly and ash particle breaking means within said housing assembly.

37. Apparatus as defined in claim 36 wherein said ash particle breaking means includes a pair of spaced breaker rolls.

38. Apparatus as defined in claim 37 wherein said breaker rolls are mounted within said housing assembly above the free surface of the volume of water in said first path.

* * * * *